US010819030B2

(12) United States Patent
Cheng

(10) Patent No.: US 10,819,030 B2
(45) Date of Patent: Oct. 27, 2020

(54) BEAM TUNABLE ANTENNA DEVICE

(71) Applicant: Delta Electronics, Inc., Taoyuan (TW)

(72) Inventor: Kuang-Kai Cheng, Taoyuan (TW)

(73) Assignee: Delta Electronics, Inc., Taoyuan (TW)

( * ) Notice: Subject to any disclaimer, the term of this patent is extended or adjusted under 35 U.S.C. 154(b) by 23 days.

(21) Appl. No.: 16/385,276

(22) Filed: Apr. 16, 2019

(65) Prior Publication Data

US 2020/0220263 A1 Jul. 9, 2020

(30) Foreign Application Priority Data

Jan. 3, 2019 (CN) ..... 2019 1 0004768

(51) Int. Cl.

| | |
|---|---|
| ***H01Q 5/35*** | (2015.01) |
| ***H01Q 15/00*** | (2006.01) |
| ***H01Q 9/06*** | (2006.01) |
| ***H01Q 9/04*** | (2006.01) |

(52) U.S. Cl.

CPC ..... *H01Q 5/35* (2015.01); *H01Q 9/045* (2013.01); *H01Q 9/0442* (2013.01); *H01Q 9/065* (2013.01); *H01Q 15/0033* (2013.01)

(58) Field of Classification Search

None

See application file for complete search history.

(56) References Cited

U.S. PATENT DOCUMENTS

2011/0151810 A1* 6/2011 Su ..... H01Q 21/205 455/129
2015/0280773 A1* 10/2015 Chang ..... H01Q 3/24 455/78
2016/0064830 A1* 3/2016 Jervis ..... H01Q 9/285 343/798
2019/0252800 A1* 8/2019 Yetisir ..... H01Q 21/065

* cited by examiner

*Primary Examiner* — Jany Richardson

(74) *Attorney, Agent, or Firm* — Muncy, Geissler, Olds & Lowe, P.C.

(57) ABSTRACT

An antenna device includes a first antenna, a second antenna, a multiplexer, and a controller. The first antenna is arranged on a first plane with a plurality of first feeding ports on the body of the first antenna to transmit or receive an electromagnetic signal on a first frequency. The second antenna, which is arranged on a second plane, includes at least four second feeding ports to transmit or receive an electromagnetic signal on a second frequency. The multiplexer has an input port coupled to the signal source, and output ports coupled to the plurality of first feeding ports and the four second feeding ports. The controller controls the multiplexer to transmit a feeding signal from the signal source to at least one of the first feeding ports and at least one of the four second feeding ports, to fine-tune the beam of the antenna device.

12 Claims, 12 Drawing Sheets

BEAM TUNABLE ANTENNA DEVICE

CROSS REFERENCE TO RELATED APPLICATIONS

This Application claims priority of China Patent Application No. 201910004768.9, filed on Jan. 3, 2019, the entirety of which is incorporated by reference herein.

FIELD OF THE PRESENT INVENTION

The present invention relates to an antenna device, and especially to a beam tunable antenna.

DESCRIPTION OF THE RELATED ART

With the rapid development of wireless communication and the rapid increase in multimedia information exchange, the next generation of wireless communication technology has to meet certain requirements, including high-speed, high-capacity, high-quality and high-elasticity. These properties are needed for use in a highly efficient spectrum application technology, wherein the spectrum is one of the increasingly valuable resources. Based on this consideration, the designers of wireless communication systems should especially consider the improvement of radio access capacity, and they should endeavor to achieve the best spectrum utilization efficiency. In recent technological developments, Wi-Fi support devices mostly use the MIMO (Multiple-input And Multiple-output) system architecture. However, based on the existing Wi-Fi used in recent communication systems, traditional antennas do not meet the requirements of recent communication. Smart antenna technology must have improved spectrum resource efficiency, system capacity and communication quality.

The traditional antenna is basically composed of multiple antennas, and the multiple antennas compensate for each other to achieve the desired effect. Since the beam pattern of the antenna itself is fixed, it is necessary to consider the placement and size of the individual antenna, but this is also the main cause of wasted space. FIG. 1A is a schematic diagram of the beam pattern of a traditional antenna with 3×3 patch antennas. As shown in FIG. 1A, the beam pattern of the patch antenna is directional (e.g., a first patch antenna set beam pattern 100, a second patch antenna set beam pattern 102, and a third patch antenna set beam pattern 104), and if it is necessary to complement the beam pattern, multiple antennas are needed to make up for the null beam pattern zone. Although the patch antenna's gain is higher than that of a dipole antenna, its directivity is directional, which corresponds to a narrow beam width. FIG. 1B is a schematic diagram of the beam pattern of a traditional antenna with 3×3 dipole antennas. As shown in FIG. 1B, the beam pattern of the dipole antenna is omnidirectional (e.g., a first dipole antenna set beam pattern 106, a second dipole antenna set beam pattern 108, and a third dipole antenna set beam pattern 110), so the beam width of the dipole antenna is wider, but the gain of the dipole antenna is lower, and therefore multiple antennas are needed to reinforce the beam pattern.

FIG. 1C is a schematic diagram of an action of a smart antenna. As shown in FIG. 1C, the smart antenna can switch the beam pattern in the required direction according to the user's requirements (such as a first smart antenna beam pattern 112, a second smart antenna radiation antenna 114, and a third smart antenna radiation antenna 116), and it is not necessary to add more antennas in the space to compensate for the null beam pattern zone, and the gain of the smart antenna is higher than that of the traditional dipole antenna. In traditional wireless network applications, spatial diversity is usually used to generate a complementary beam pattern to obtain a diversity gain, which has been against the multipath interference phenomenon of the wireless channel to enhance wireless access capability. However, the smart antenna can utilize a signal directional beam-forming technique to generate a specific beam shape, and the main beam can be aimed at the target signal source to enhance reception quality.

Most of the more recent smart antennas use a plurality of antennas as a switching mechanism to change the overall beam pattern by switching between different antennas therein, but the structure is extremely complicated and the volume is correspondingly large. It takes too much space to form an antenna unit.

BRIEF SUMMARY OF THE PRESENT INVENTION

In order to resolve the issue described above, the present invention discloses an antenna device comprising a first antenna, a second antenna, a multiplexer, and a controller. The first antenna arranged on a baseboard has a height from a first plane to the baseboard and has a plurality of first feeding ports arranged on the body of the first antenna for transmitting or receiving a first frequency electromagnetic signal. The distance between each adjacent first feeding port is identical on the body of the first antenna. The second antenna arranged on a baseboard has a height from a second plane to the baseboard for transmitting or receiving a second frequency electromagnetic signal. The second antenna includes a central part, at least four radiation parts surrounding the central part, at least four connection parts, and at least four second feeding ports. The four connection parts connect the four radiation parts to the central part at the middle point of each of the radiation parts. The second feeding ports are respectively arranged at the middle point of each of the radiation parts. The multiplexer has an input port coupled to the signal source and has output ports coupled to the plurality of first feeding ports and the four second feeding ports. The controller outputs a control signal to the multiplexer, so that the multiplexer can switch to different transmission paths for transmitting a feeding signal from the signal source to the first feeding port or to at least one of the second feeding ports to adjust the beam pattern of the first antenna or the second antenna.

According to the antenna device disclosed above, the four radiation parts of the second antenna are arranged in the shape of a regular polygon or a loop that surrounds the central part at the center of the regular polygon or loop.

According to the antenna device disclosed above, the second plane is parallel to the first plane, and the center of the central part of the second antenna is aligned with the center of the first antenna.

According to the antenna device disclosed above, and based on the top view from the first plane and the second plane to the baseboard, when the first frequency is lower than the second frequency, the second antenna is arranged within the first antenna; and when the first frequency is higher than the second frequency, the first antenna is arranged within the radiation parts of the second antenna.

The antenna device disclosed above, further comprising a plurality of conductor pillars arranged on the baseboard; wherein when the first frequency is lower than the second frequency, the plurality of first feeding ports are coupled to the first antenna and the output node of the multiplexer via the plurality of conductor pillars, so that the height of the first antenna above the baseboard is greater than that of the second antenna, and the second plane is arranged on the upper surface of the baseboard.

The antenna device disclosed above, further comprising a plurality of conductor pillars arranged on the baseboard; wherein when the first frequency is higher than the second frequency, the second feeding ports are coupled to the second antenna and the output node of the multiplexer via the conductor pillars, so that the height of the second antenna above the baseboard is greater than that of the first antenna, and the first plane is arranged on the upper surface of the baseboard.

According to the antenna device disclosed above, the length of the conductor pillars is equal to one-eighth to one-quarter of the wavelength of the first frequency electromagnetic signal.

According to the antenna device disclosed above, the length of the conductor pillars is equal to one-eighth to one-quarter of the wavelength of the second frequency electromagnetic signal.

According to the antenna device disclosed above, when the first antenna transmits or receives the first frequency electromagnetic signal, the corresponding current path length is equal to one-half of the wavelength of the first frequency electromagnetic signal; and when the second antenna transmits or receives the second frequency electromagnetic signal, the corresponding current path length is equal to one-half of the wavelength of the second frequency electromagnetic signal.

According to the antenna device disclosed above, the controller is configured to select at least one of the first feed ports or at least one of the second feeding ports, and another plurality of first and second feeding ports have an open-circuit status.

According to the antenna device disclosed above, there are at least four first feeding ports.

The antenna device disclosed above further comprises a plurality of third antennas and a second controller; wherein the plurality of third antennas are arranged around the first antenna and the second antenna, and each of the plurality of third antennas comprises an antenna excitation element and at least three beam pattern adjustment boards. The antenna excitation element is coupled to the signal source to transmit or receive the first frequency electromagnetic signal and the second frequency electromagnetic signal. The antenna excitation element is arranged on the surface of the baseboard. Each of the beam pattern adjustment boards is erected on the surface of the baseboard and surrounds the antenna excitation element, and each is respectively coupled to the baseboard through a switch.

DETAILED DESCRIPTION OF THE PRESENT INVENTION

The present invention can be more fully understood by reading the subsequent detailed description with references made to the accompanying figures.

It should be understood that the figures are not drawn to scale in accordance with standard practice in the industry. In fact, it is allowed to arbitrarily enlarge or reduce the size of devices for clear illustration.

Figure 1A:
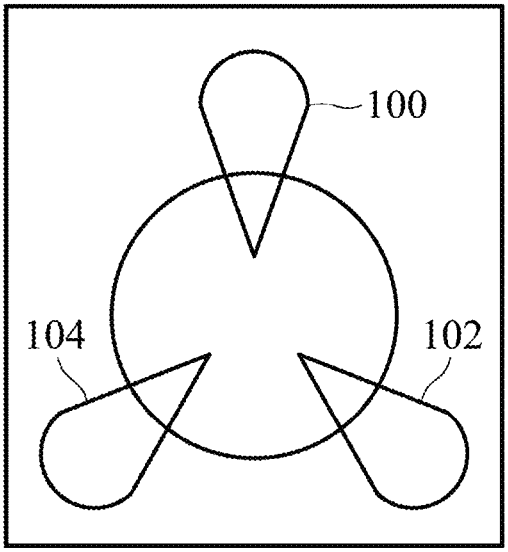
FIG. 1A is a schematic diagram of the beam pattern of a traditional antenna with 3×3 patch antennas.
Figure 1B:
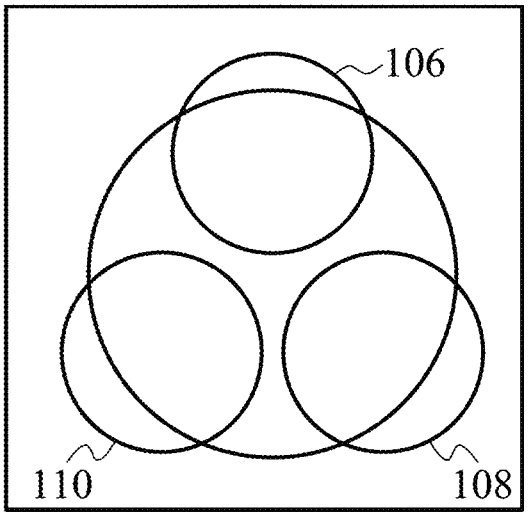
FIG. 1B is a schematic diagram of the beam pattern of a traditional antenna with 3×3 dipole antennas.
Figure 1C:
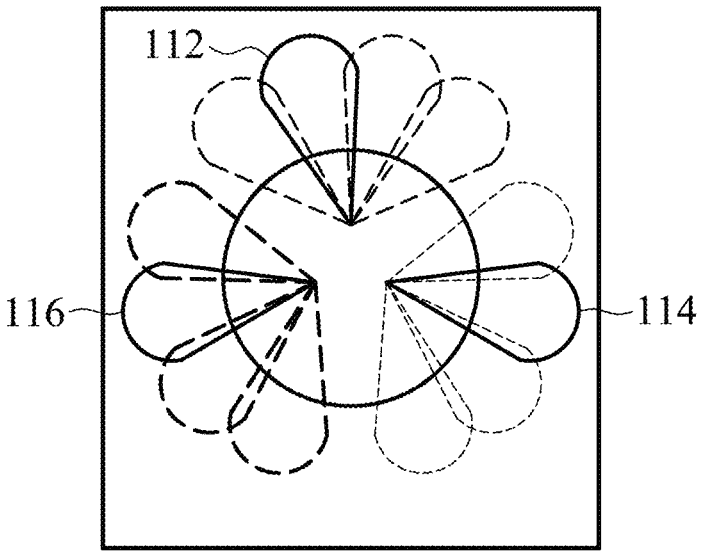
FIG. 1C is a schematic diagram of an action of a smart antenna.
Figure 2A:
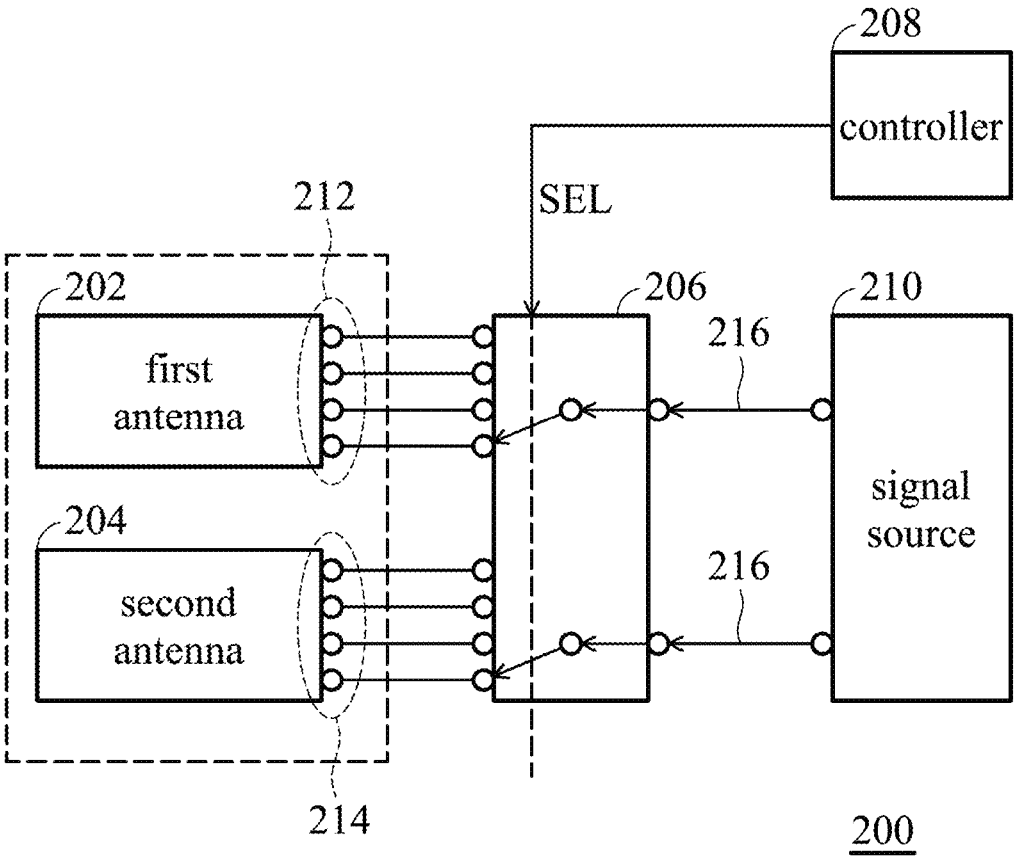
FIG. 2A is a block diagram of an antenna device in accordance with an embodiment of the disclosure.

FIG. 2A is a block diagram of an antenna device in accordance with an embodiment of the disclosure. As shown in FIG. 2A, antenna device 200 includes a first antenna 202, a second antenna 204, a multiplexer 206, and a controller 208. The first antenna 202 has a plurality of first feeding ports 212 arranged on the body of the first antenna 202. In the present embodiment, there are four first feeding ports, and the first antenna 202 transmits or receives an electromagnetic signal on a first frequency. The second antenna 204 has at least four second feeding ports 214 for transmitting or receiving an electromagnetic signal on a second frequency. The input port of the multiplexer 206 is coupled to the signal source 210, and the output port of the multiplexer 206 is coupled to the plurality of first feeding ports 212 of the first antenna 202 and the second feeding ports of the second antenna 204. The controller 208 outputs a control signal SEL to the multiplexer 206, so that the multiplexer 206 can switch to different transmission paths for transmitting a feeding signal 216 (which can be a first frequency signal or a second frequency signal) from the signal source 210 to at least one of the first feeding ports 212 or at least one of the second feeding ports 214 to adjust the beam pattern of the first antenna 202 or the second antenna 204.

Figure 2B:
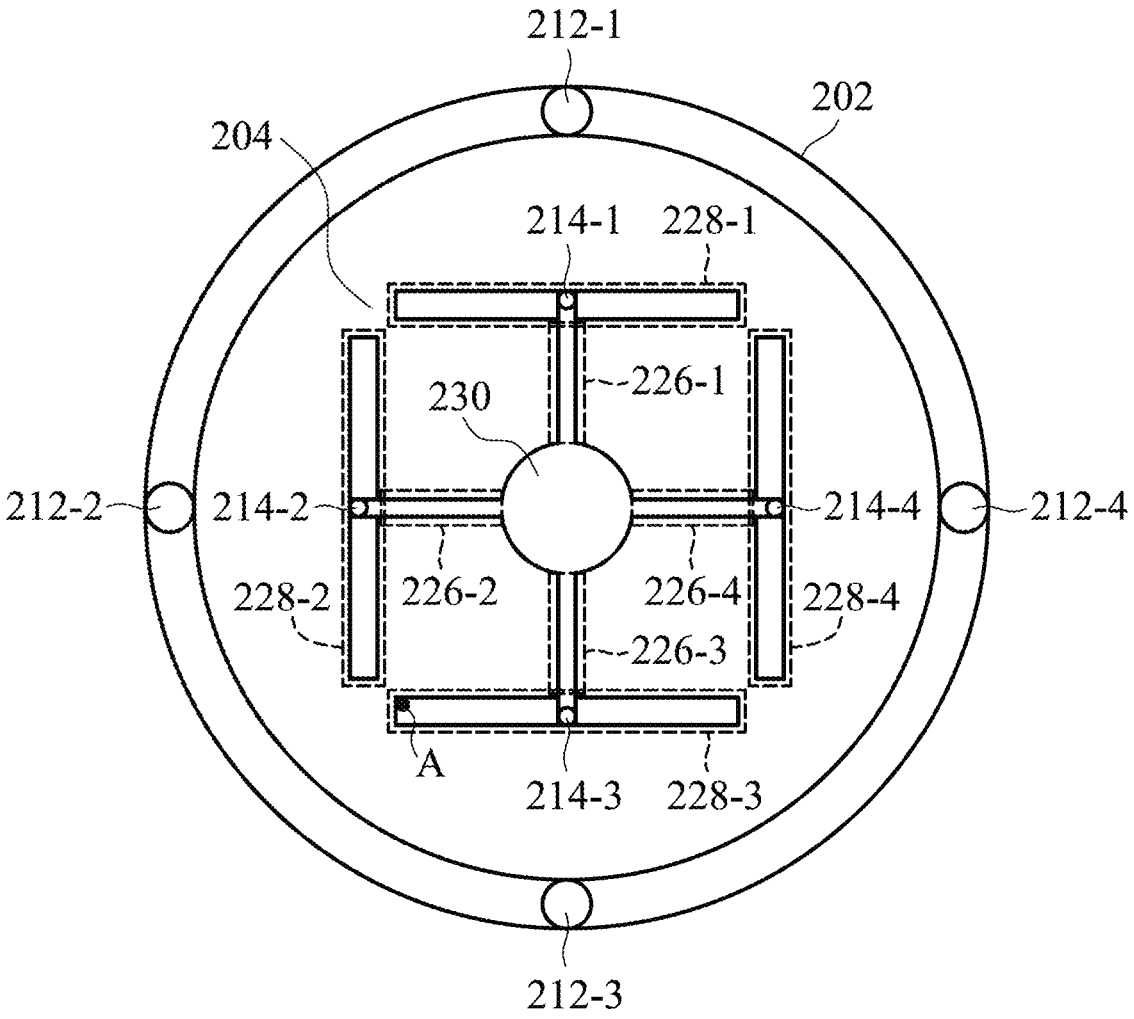
FIG. 2B is a top view diagram of a first antenna and a second antenna in accordance with the embodiment of the disclosure.
Figure 2C:
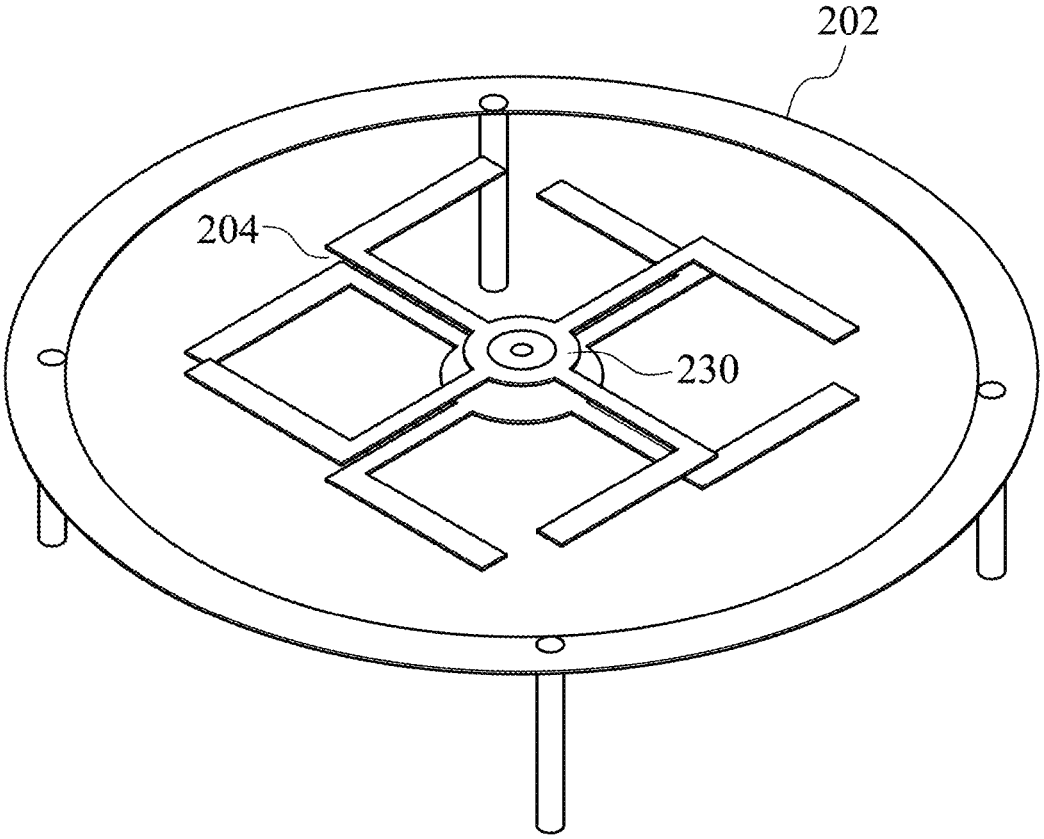
FIG. 2C is a stereogram of the first antenna and the second antenna in accordance with the embodiment of the disclosure.
Figure 2D:
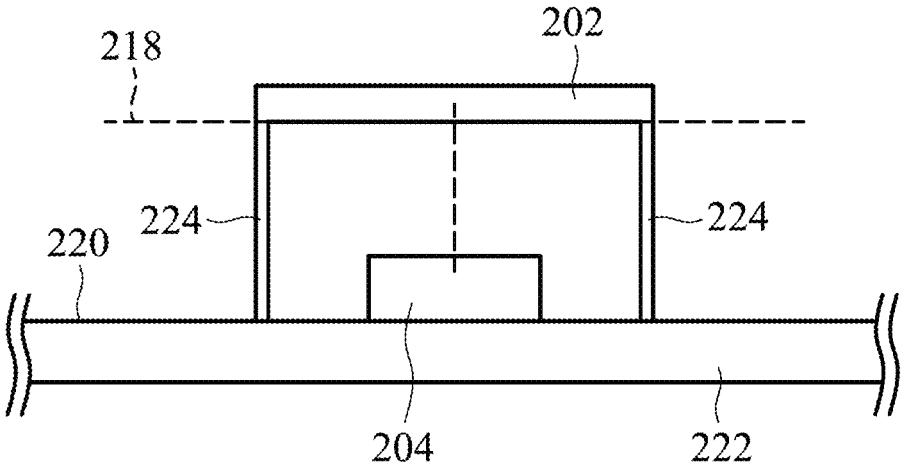
FIG. 2D is a sectional view diagram of the first antenna and the second antenna in accordance with the embodiment of the disclosure.

FIG. 2B, 2C and 2D are a top view diagram, a stereogram and a sectional view diagram of the first antenna 202 and the second antenna 204 in accordance with the embodiment of the disclosure. Referring to FIG. 2B and 2D, the first antenna 202 is arranged on the first plane 218 (FIG. 2D), and the distance between each adjacent first feeding port 212 (including the first feeding ports 212-1, 212-2, 212-3 and 212-4) is identical on the body of the first antenna 202. For example, as shown in FIG. 2B, if the first feeding port 212-1 is arranged in the position of 0° at the first antenna 202, then the first feeding ports 212-2, 212-3 and 212-4 are arranged respectively in the positions of 90°, 180° and 270° from the first antenna 202. Thus, the distance between the first feeding ports 212-1 and 212-2, the distance between the first feeding ports 212-2 and 212-3, the distance between the first feeding ports 212-3 and 212-4, and the distance between the first feeding ports 212-4 and 212-1 are all identical, so that when the first antenna starts to radiate, the corresponding current path length is also identical. For example, when the feeding signal 216 is input from the first feeding port 212-1, the corresponding current path length during radiation is identical to the distance between the first feeding ports 212-1 and 212-2 on the body of the first antenna 202. In the present embodiment, based on a top view from the first plane 218 and a second plane 220 to a baseboard 222 (FIG. 2D), the second antenna 204 is arranged within the first antenna 202.

For example, when the electromagnetic signal on the first frequency transmitted or received by the first antenna 202 is a 2.4 GHz electromagnetic signal, the distance between the first feeding ports 212-1 and 212-2 on the body of the first antenna 202 should be one-half of the wavelength of the electromagnetic signal on the first frequency, which is 0.0625 meters. When the first frequency electromagnetic signal transmitted or received by the first antenna 202 is a 5 GHz electromagnetic signal, the distance between the first feeding ports 212-1 and 212-2 on the body of the first antenna 202 should be one-half of the wavelength of the electromagnetic signal on the first frequency, which is 0.03 meters.

The second antenna 204 is arranged on the second plane 220 (for example, when it is arranged on the surface of the baseboard 222), and the second antenna 204 includes a central part 230, at least four radiation parts 228-1, 228-2, 228-3 and 228-4, at least four connection parts 226-1, 226-2, 226-3 and 226-4, and at least four second feeding ports. The radiation parts 228-1, 228-2, 228-3 and 228-4 are arranged in the shape of a regular polygon or loop that surrounds the central part 230 at the center of the regular polygon or loop. The four connection parts 226-1, 226-2, 226-3 and 226-4 connect the four radiation parts 228-1, 228-2, 228-3 and 228-4 to the central part 230 at the middle point of each of the connection parts 226-1, 226-2, 226-3 and 226-4, so that the second antenna 204 is made approximately to substantially have a "田" shape (for example, FIG. 2B). The second feeding ports 214 (which include second feeding ports 214-1, 214-2, 214-3 and 214-4) are respectively arranged at the middle point of each of the radiation parts 228-1, 228-2, 228-3 and 228-4. As shown in FIG. 2C, the second antenna 204 is formed on the corresponding planes on both sides of a printed circuit board (PCB) (not shown), and the corresponding planes on both sides of the PCB are coupled by a through-hole technique. The electromagnetic signal on the second frequency is input to the second antenna 204 from the second feeding ports 214-1, 214-2, 214-3 and 214-4 (FIG. 2B), and the electromagnetic signal on the second frequency is radiated from the layout traces on both sides of the PCB on the second antenna 204 by connection via through holes.

For example, the second antenna 204 starts to radiate when the feeding signal 216 is input to the second antenna 204 from the second feeding port 214-1 by the controller 208 selecting, and a corresponding current path during radiation is from the second feeding port 214-1, through the central part 230, to a node A of the radiation part 228-3 where the second feeding port 214-3 is located. For example, when the electromagnetic signal on the second frequency transmitted or received by the second antenna 204 is a 5 GHz electromagnetic signal, the corresponding wavelength is about 0.06 meters (that is λ (wavelength)=C (light speed)÷f (frequency) $=(3*10^8)$ $(5*10^9)$). Thus, the distance between the second feeding port 214-1 and the node A of the radiation part 228-3 where the second feeding port 214-3 is located should be one-half of the wavelength of the electromagnetic signal on the second frequency, which is 0.03 meters. When the electromagnetic signal on the second frequency transmitted or received by the second antenna 204 is a 2.4 GHz electromagnetic signal, the corresponding wavelength is about 0.125 meters. Thus, the distance between the second feeding port 214-1 and the node A of the radiation part 228-3 where the second feeding port 214-3 is located should be one-half of the wavelength of the electromagnetic signal on the second frequency, which is 0.0625 meters.

As shown in FIG. 2D, the first plane 218 is parallel to the second plane 220, and the center of the central part 230 (FIG. 2B) of the second antenna 204 is aligned with the center of the first antenna 202. The baseboard 222 is arranged below the first plane 218 and the second plane 220 is on the baseboard 222. Based on a top view from the first plane 218 and the second plane 220 to the baseboard 222, when the first frequency is lower than the second frequency, such as when the first frequency is 2.4 GHz and the second frequency is 5 GHz, since the current path of the first frequency corresponding to the first antenna 202 is longer, the current path of the second frequency corresponding to the second antenna 204 is shorter, and the size of the first antenna 202 is greater than that of the second antenna 204, and therefore the second antenna 204 is arranged within the first antenna 202. In contrast, in other embodiments, based on a top view from the first plane 218 and the second plane 220 to the baseboard 222, when the first frequency is higher than the second frequency, such as when the first frequency is 5 GHz and the second frequency is 2.4 GHz, since the current path of the second frequency corresponding to the second antenna 204 is longer, the current path of the first frequency corresponding to the first antenna 202 is shorter, the size of the second antenna 204 is greater than that of the first antenna 202, and therefore the first antenna 202 is arranged within (the region substantially defined by) the radiation parts 228-1, 228-2, 228-3 and 228-4 of the second antenna 204.

In the present embodiment, as shown in FIG. 2D, the antenna device 200 may further include a plurality of conductor pillars 224. When the first frequency is lower than the second frequency, such as when the first frequency is 2.4 GHz and the second frequency is 5 GHz, the plurality of first feeding ports 212 are coupled to the first antenna 202 and the output node of the multiplexer 206 via the plurality of conductor pillars 224, so that the height of the first plane 218 where the first antenna 202 is located above the baseboard 222 is greater than that of the second plane 220 where the second antenna 204 is located, and the second plane 220 is arranged on the upper surface of the baseboard 222. In the present embodiment, the length of the conductor pillars 224 is equal to one-eighth to one-quarter of the wavelength of the electromagnetic signal on the first frequency, which is 0.015625 meters to 0.03125 meters. The plurality of conductor pillars 224 are coupled to the output node of the multiplexer 206 via the layout traces on the baseboard 222.

In other embodiments, when the first frequency is higher than the second frequency, such as when the first frequency is 5 GHz and the second frequency is 2.4 GHz, the second feeding ports 214 are coupled to the second antenna 204 and the output node of the multiplexer 206 via the plurality of conductor pillars 224, so that the height of the second plane 220 where the second antenna 204 is located above the baseboard 222 is greater than that of the first plane 218 where the first antenna 202 is located, and the first plane 218 is arranged on the upper surface of the baseboard 222. In the present embodiment, the length of the conductor pillars 224 is equal to one-eighth to one-quarter of the wavelength of the electromagnetic signal on the second frequency, which is 0.015625 meters to 0.03125 meters.

Figure 2E:
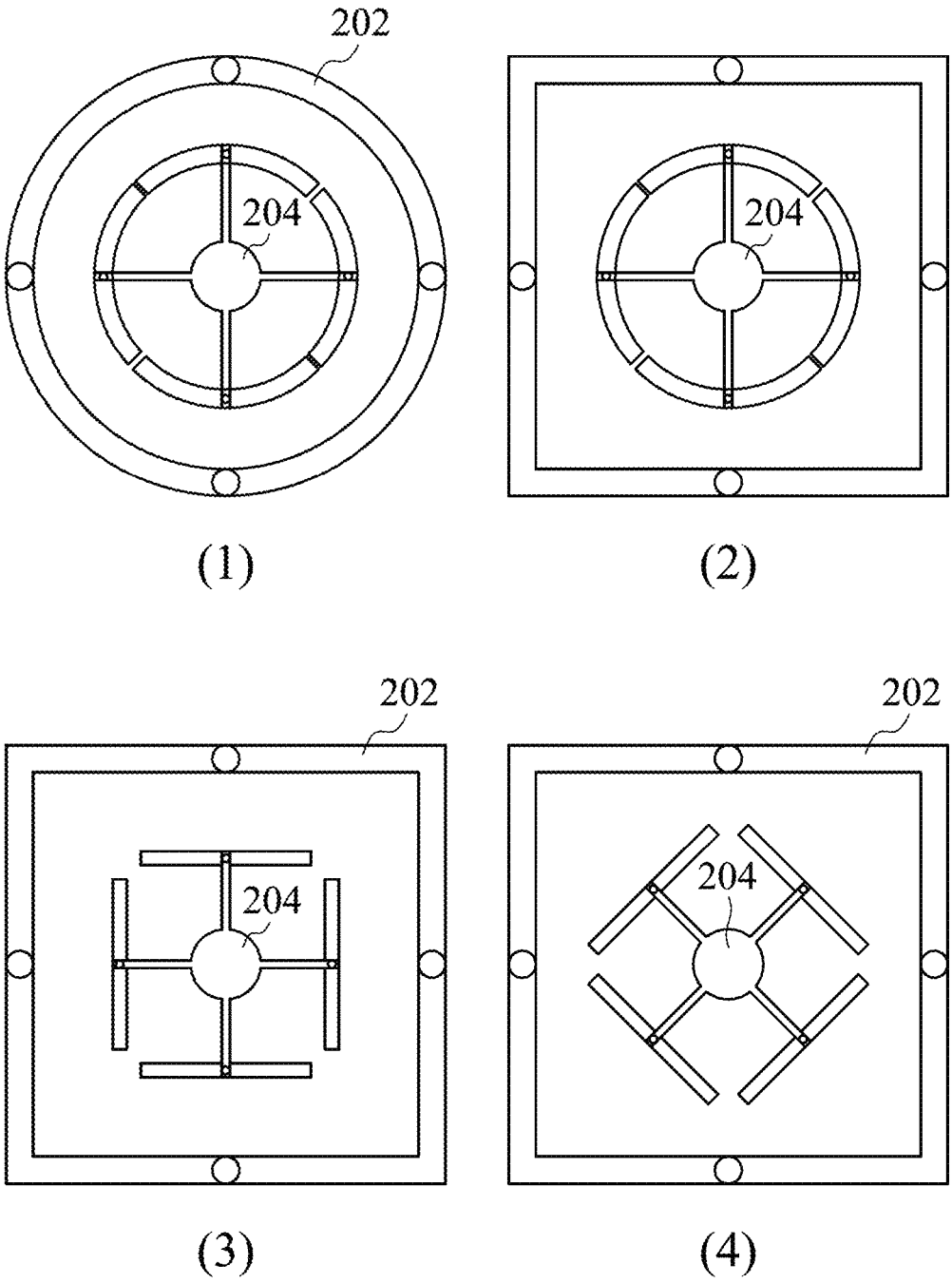
FIG. 2E is a top view diagram of the first antenna and the second antenna in accordance with other embodiments of the disclosure.

FIG. 2E is a top view diagram of the first antenna 202 and the second antenna 204 in accordance with other embodiments of the disclosure. As shown in FIG. 2E, in embodiment (1), the first antenna 202 and the second antenna 204 are both in the shape of a loop, and the center of the first antenna 202 is aligned with the center of the second antenna 204. In embodiment (2), the first antenna 202 is in the shape of a regular polygon, the second antenna 204 is in the shape of a loop, and the center of the first antenna 202 is aligned with the center of the second antenna 204. In embodiment (3), the first antenna 202 and the second antenna 204 are both in the shape of a regular polygon, and the center of the first antenna 202 is aligned with the center of the second antenna 204. In embodiment (4), the first antenna 202 and the second antenna 204 are both in the shape of a regular polygon, and the center of the first antenna 202 is aligned with the center of the second antenna 204. Compared with embodiment (3) and (4), the position of the second antenna 204 in the embodiment (4) is rotated by 45° along the center of the second antenna 204.

Figure 2F:
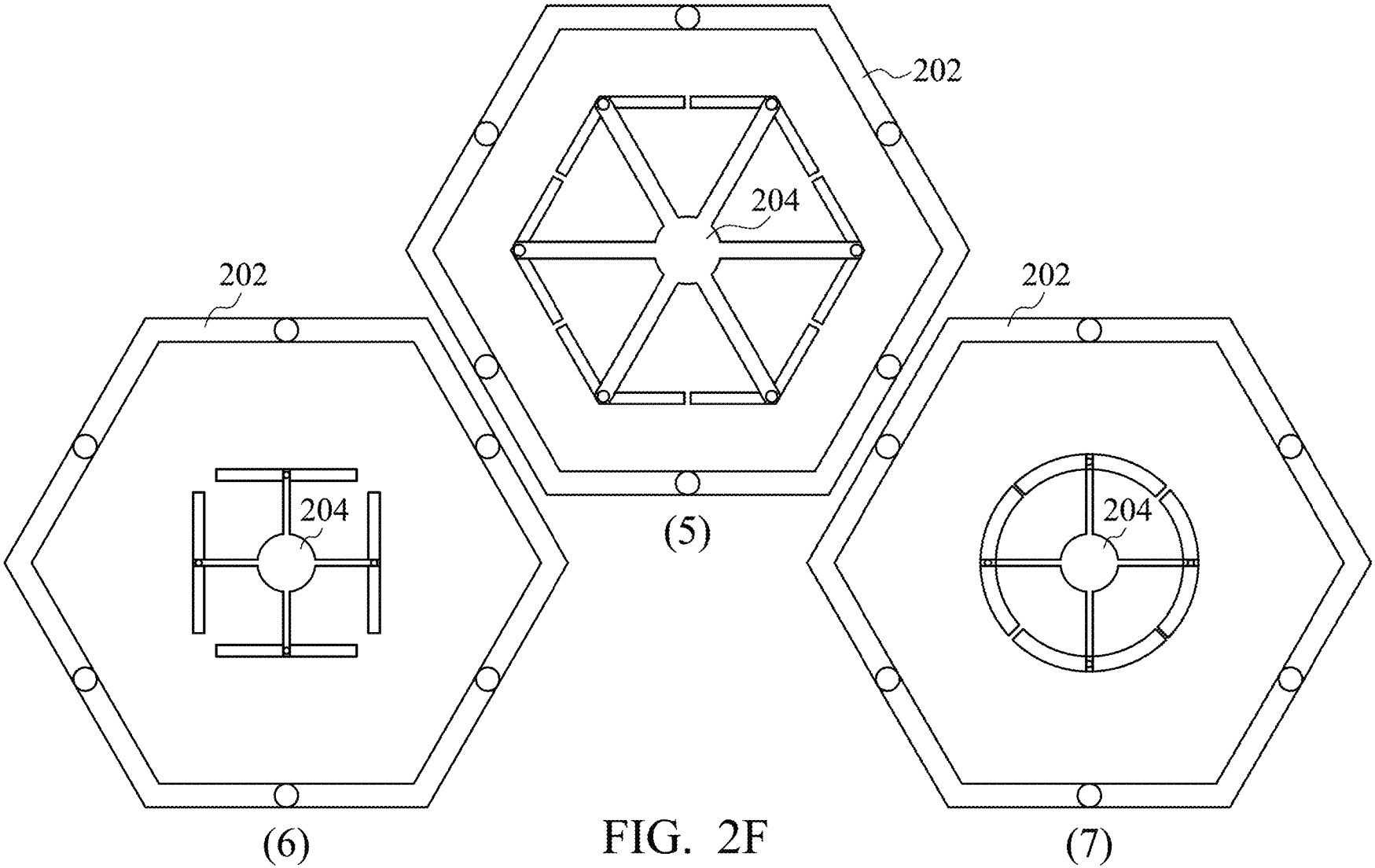
FIG. 2F is a top view diagram of the first antenna and the second antenna in accordance with other embodiments of the disclosure.

FIG. 2F is a top view diagram of the first antenna 202 and the second antenna 204 in accordance with other embodiments of the disclosure. As shown in FIG. 2F, in embodiment (5), the first antenna 202 and the second antenna 204 are both in the shape of a hexagon, and each has six first and second feeding ports. In embodiment (6), the first antenna 202 is in the shape of a hexagon and has six first feeding ports, and the second antenna 204 is in the shape of a square and has four second feeding ports. In embodiment (7), the first antenna 202 is in the shape of a hexagon and has six first feeding ports, and the second antenna 204 is in the shape of a loop and has four second feeding ports.

Figure 3:
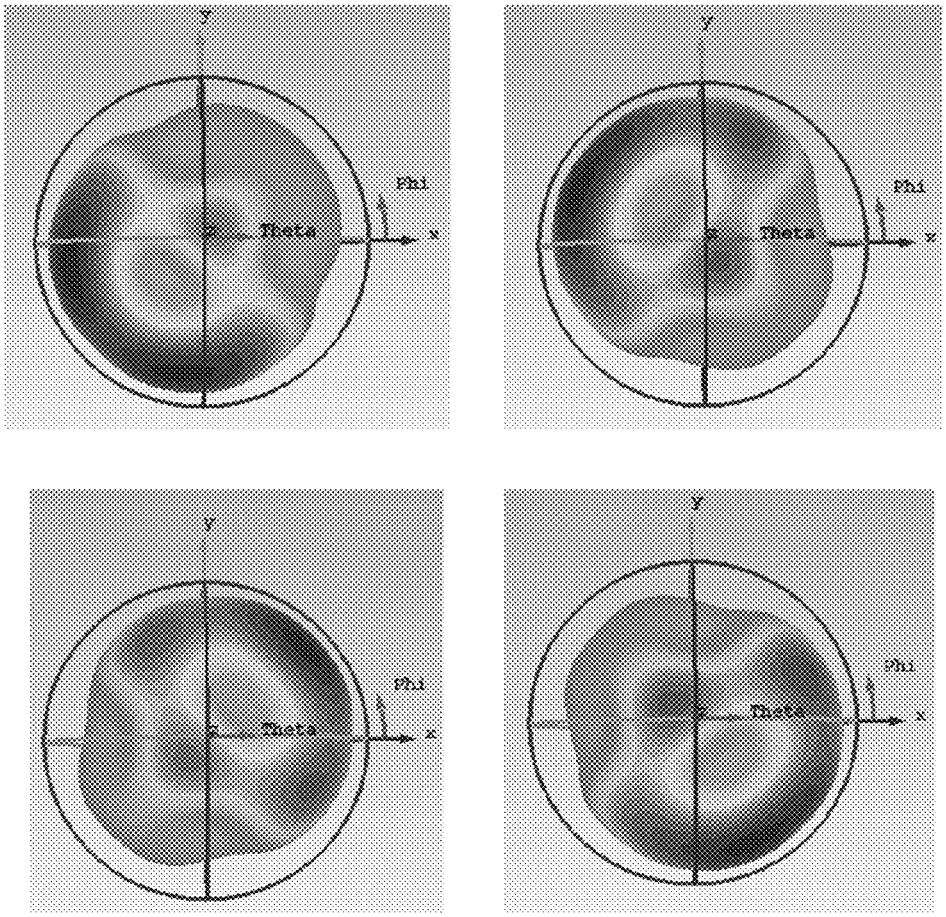
FIG. 3 is a schematic diagram of beam pattern variation of the first antenna switching first feeding ports in accordance with other embodiments of the disclosure.

FIG. 3 is a schematic diagram of beam pattern variation of the first antenna 202 upon switching first feeding ports 212 in accordance with other embodiments of the disclosure. As shown in FIG. 3, x-y plane is the first plane 218 disclosed in FIG. 2D. When the first frequency is 2.4 GHz, the controller 208 outputs the feeding signal 216 to the different first feeding ports 212-1, 212-2, 212-3 or 212-4 via switching the multiplexer 206, so that the first antenna 202 generates beam patterns corresponding to the direction shown in FIG. 3, and the purpose of adjusting directivity of the beam pattern is then achieved.

Figure 4:
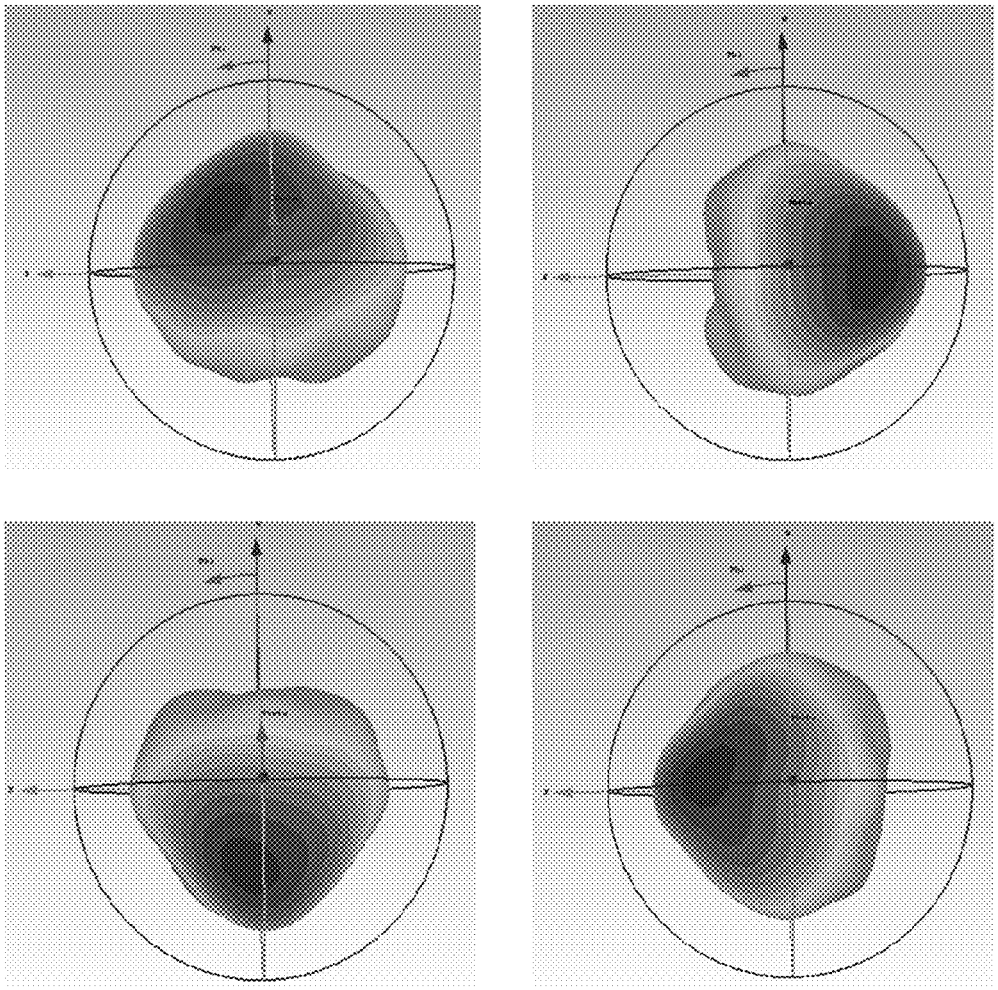
FIG. 4 is a schematic diagram of beam pattern variation of the second antenna switching second feeding ports in accordance with other embodiments of the disclosure.

FIG. 4 is a schematic diagram of beam pattern variation of the second antenna 204 switching the second feeding ports 214 in accordance with other embodiments of the disclosure. As shown in FIG. 4, x-y plane is the second plane 220 disclosed in FIG. 2D. When the second frequency is 5 GHz, the controller 208 outputs the feeding signal 216 to the different second feeding ports 214-1, 214-2, 214-3 or 214-4 via switching the multiplexer 206, so that the second antenna 204 generates beam patterns corresponding to the direction shown in FIG. 4, and the purpose of adjusting directivity of the beam pattern is then achieved.

In some embodiments, when the controller 208 selects at least one of the first feeding ports 212 or at least one of the second feeding ports 214 to input the feeding signal 216, and another plurality of first and the second feeding ports (212 and 214) have an open-circuit status. For example, when the controller 208 selects the first feeding port 212-3 and the second feeding port 214-1 to input the feeding signal 216, at this time, the first feeding ports 212-1, 212-2 and 212-4 and the second feeding ports 214-2, 214-3 and 214-4 all have an open-circuit status, so that isolation is better without interfering with the normal operation of the first antenna 202 and the second antenna 204.

Figure 5A:
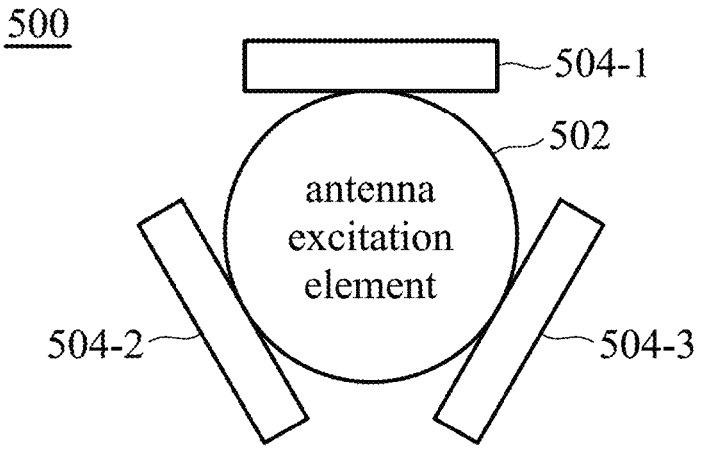
FIG. 5A is a top view diagram of a third antenna in accordance with the embodiment of the disclosure.
Figure 5B:
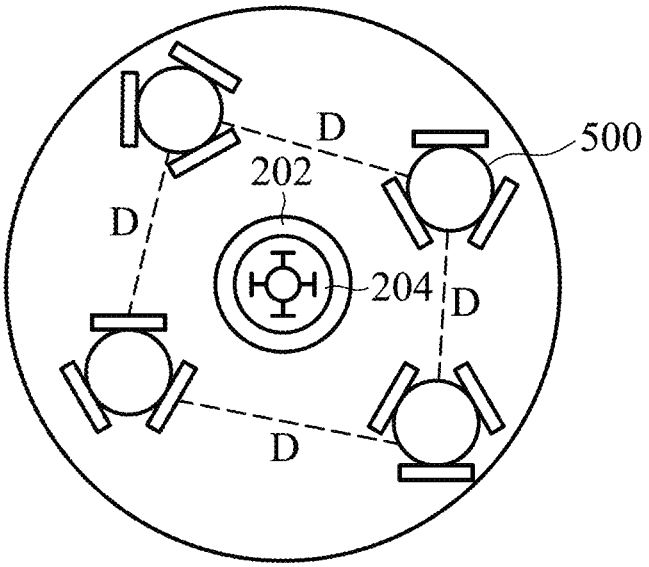
FIG. 5B is a top view diagram of the arrangement of the first antenna, the second antenna and the third antenna in accordance with the embodiment of the disclosure.
Figure 5C:
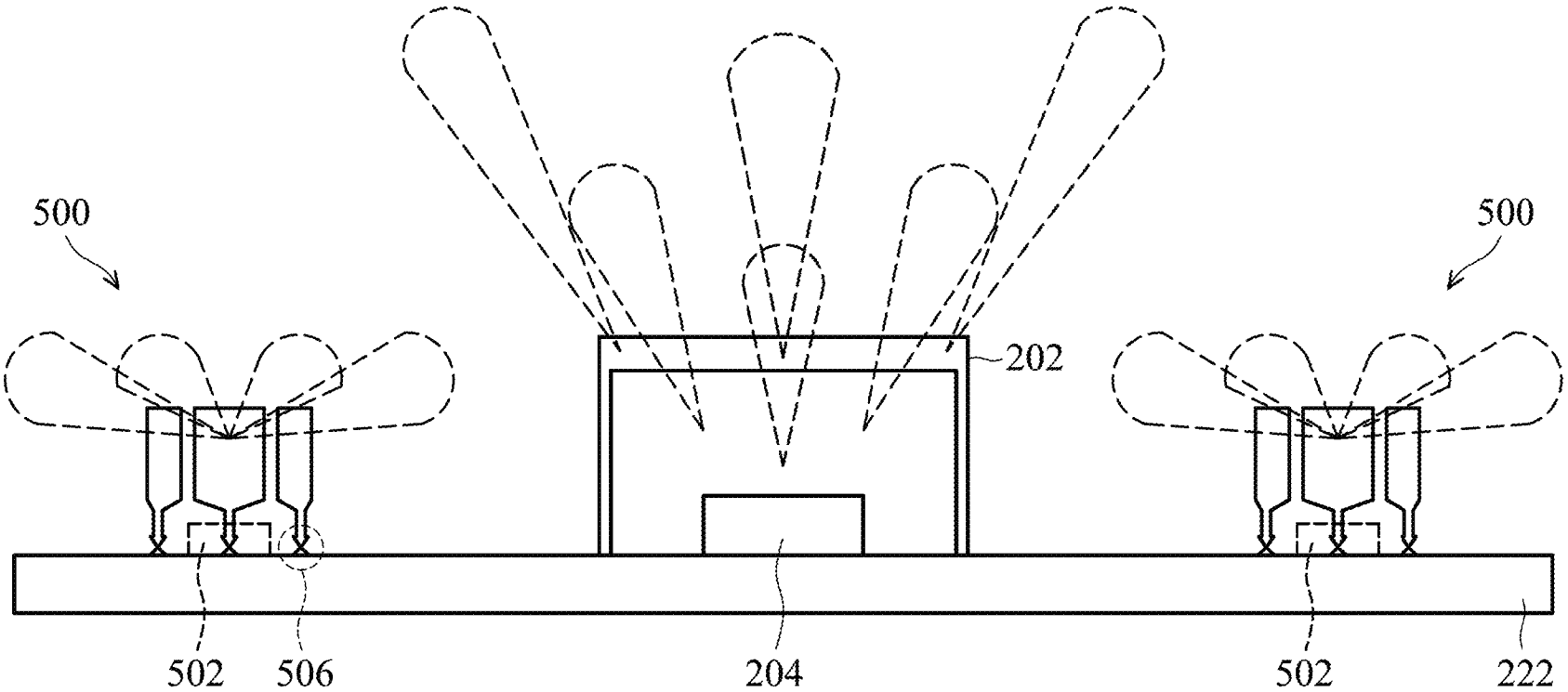
FIG. 5C is a sectional view diagram of the arrangement of the first antenna, the second antenna and the third antenna in accordance with the embodiment of the disclosure.

The antenna device 200 may further include a plurality of third antennas 500 and a second controller. Referring to FIG. 5A, 5B and 5C at the same time, FIG. 5A is a top view diagram of a third antenna 500 in accordance with the embodiment of the disclosure. FIG. 5B is a top view diagram of the arrangement of the first antenna 202, the second antenna 204 and the third antenna 500 in accordance with the embodiment of the disclosure. FIG. 5C is a sectional view diagram of the arrangement of the first antenna 202, second antenna 204 and the third antenna 500 in accordance with the embodiment of the disclosure. As shown in FIG. 5B, the plurality of third antennas 500 are arranged around the first antenna 202 and the second antenna 204. As shown in FIG. 5A, each third antenna 500 includes an antenna excitation element 502 and three beam pattern adjustment boards 504-1, 504-2 and 504-3. The antenna excitation element 502 transmits or receives the electromagnetic signal on the first frequency or the second frequency. The antenna excitation element 502 is arranged on the surface of the baseboard 222 (as shown in FIG. 5C). For example, the antenna excitation element 502 can transmit or receive 2.4 GHz and 5 GHz electromagnetic signals. Each of the three beam pattern adjustment boards 504-1, 504-2 and 504-3 is erected on the surface of the baseboard 222 and surrounds the antenna excitation element 502, and each is respectively coupled to the baseboard 222 through a switch 506. The second controller controls the switch 506 of at least one of the three beam pattern adjustment boards 504-1, 504-2 and 504-3, so that the beam pattern adjustment boards 504-1, 504-2 or 504-3 can be coupled to the baseboard 222 and grounded, and the beam pattern of the antenna excitation element 502 can be adjusted. The switch 506 can be a diode.

As shown in FIG. 5B, the distance between each adjacent two of the third antennas 500 is D, wherein the distance D may be 1.3 times to 1.8 times the wavelength of the electromagnetic signal on the first frequency and the second frequency. For example, when the first frequency is 2.4 GHz, the corresponding wavelength is 0.125 meters, so the distance D can be 0.1625 meters to 0.225 meters. In addition, the position of each third antenna 500 surrounding the first antenna 202 and second antenna 204 can be allocated at an angle of 360°/N, wherein N is the total number of third antennas 500. As shown in FIG. 5B, each of the third antenna 500 is evenly allocated around the first antenna 202 and second antenna 204, and the angle between each adjacent third antenna 500 is 90°.

For example, as shown in FIG. 5C, when the antenna excitation element 502 of each of the third antennas 500 is coupled to the signal source 210 (not shown) and transmits an electromagnetic signal on a first frequency (such as 2.4 GHz), the second controller switches the grounding of the three beam pattern adjustment boards (such as beam pattern adjustment board 504-1), so that the beam pattern of the antenna excitation element 502 is directed in a specific direction. At this time, the controller 208 is configured to select at least one of the first feeding ports (such as first feeding port 212-1) of the first antenna 202 for inputting the feeding signal 216, so that the beam pattern corresponding to the first frequency (2.4 GHz) of the first antenna 202 is also directed in the specific direction to enhance the beam directivity of the entire antenna device 200 at the first frequency. Similarly, on the second frequency (such as 5 GHz), the second antenna 204 can also enhance the beam directivity of the entire antenna device 200, and therefore it will not be described again.

In the present embodiments, for the first antenna 202 and the second antenna 204, in order to determine which one of the first feeding ports 212 or which one of the second feeding ports 214 is the optimal feeding port, the controller 208 can continuously switch the different first feeding ports or the different second feeding ports to find the optimal feeding port, and simultaneously receive a test object signal and record the corresponding RSSI value of the test object signal. The controller 208 is configured to select first feeding ports 212 or second feeding ports 214 in accordance with the recorded RSSI value.

The ordinal in the specification and the claims of the present invention, such as "first", "second", "third", etc., has no sequential relationship, and is just for distinguishing between two different devices with the same name. In the specification of the present invention, the word "couple" refers to any kind of direct or indirect electronic connection. The present invention is disclosed in the preferred embodiments as described above, however, the breadth and scope of the present invention should not be limited by any of the embodiments described above. Persons skilled in the art can make small changes and retouches without departing from the spirit and scope of the invention. The scope of the invention should be defined in accordance with the following claims and their equivalents.

What is claimed is:

1. An antenna device, comprising:

a first antenna, arranged on a baseboard, having a height from a first plane to the baseboard and having a plurality of first feeding ports arranged on a body of the first antenna for transmitting or receiving an electromagnetic signal on a first frequency; wherein, a distance between each adjacent two of the first feeding ports is identical on the body of the first antenna;

a second antenna, arranged on the baseboard, having a height from a second plane to the baseboard for transmitting or receiving an electromagnetic signal on a second frequency;

wherein the second antenna comprises a central part, at least four radiation parts surrounding the central part, at least four connection parts, and at least four second feeding ports;

wherein the at least four connection parts connect the at least four radiation parts and the central part from a middle point of each of the at least four radiation parts;

wherein the at least four second feeding ports are respectively arranged at the middle point of each of the at least four radiation parts;

a multiplexer, having an input port coupled to a signal source and having output ports coupled to the plurality of first feeding ports and the at least four second feeding ports;

a controller, outputting a control signal to the multiplexer, so that the multiplexer can switch to different transmission paths for transmitting a feeding signal from the signal source to the at least one of the first feeding ports or at least one of the at least four second feeding ports to adjust a beam pattern of the first antenna or the second antenna.

2. The antenna device as claimed in claim 1, wherein the at least four radiation parts of the second antenna are arranged in shape of a regular polygon or a loop which surrounds the central part at a center of the regular polygon or loop.

3. The antenna device as claimed in claim 1, wherein the second plane is parallel to the first plane, and a center of the central part of the second antenna is aligned with a center of the first antenna.

4. The antenna device as claimed in claim 2, wherein based on a top view from the first plane and the second plane to the baseboard, when the first frequency is lower than the second frequency, the second antenna is arranged within the first antenna; when the first frequency is higher than the second frequency, the first antenna is arranged within the at least four radiation parts of the second antenna.

5. The antenna device as claimed in claim 3, further comprising a plurality of conductor pillars arranged on the baseboard; wherein when the first frequency is lower than the second frequency, the plurality of first feeding ports are coupled to the first antenna and the output node of the multiplexer via the plurality of conductor pillars, so that the height of the first antenna above the baseboard is greater than that of the second antenna, and the second plane is arranged on an upper surface of the baseboard.

6. The antenna device as claimed in claim 3, further comprising a plurality of conductor pillars arranged on the baseboard; wherein when the first frequency is higher than the second frequency, the at least four second feeding ports are coupled to the second antenna and the output node of the multiplexer via the plurality of conductor pillars, so that the height of the second antenna above the baseboard is greater than that of the first antenna, and the first plane is arranged on an upper surface of the baseboard.

7. The antenna device as claimed in claim 4, wherein a length of the conductor pillars is equal to one-eighth to one-quarter of a wavelength of the electromagnetic signal on the first frequency.

8. The antenna device as claimed in claim 5, wherein the length of the conductor pillars is equal to one-eighth to one-quarter of the wavelength of the electromagnetic signal on the second frequency.

9. The antenna device as claimed in claim 1, wherein when the first antenna transmits or receives the electromagnetic signal on the first frequency, a corresponding current path length is equal to one-half of a wavelength of the electromagnetic signal on the first frequency; when the second antenna transmits or receives the electromagnetic signal on the second frequency, the corresponding current path length is equal to one-half of a wavelength of the electromagnetic signal on the second frequency.

10. The antenna device as claimed in claim 1, wherein the controller is configured to select at least one of the first feed ports or at least one of the at least four second feeding ports, and another plurality of first and second feeding ports have an open-circuit status.

11. The antenna device as claimed in claim 1, wherein the number of first feeding ports is at least four.

12. The antenna device as claimed in claim 3, further comprising a plurality of third antennas and a second controller; wherein the plurality of third antennas are arranged around the first antenna and the second antenna; each of the third antennas comprising:

an antenna excitation element, coupling to the signal source to transmit or receive the electromagnetic signal on the first frequency and the second frequency;

wherein the antenna excitation element is arranged on a surface of the baseboard;

at least three beam pattern adjustment boards; wherein each of the at least three beam pattern adjustment boards is erected on the surface of the baseboard and surrounds the antenna excitation element, and each is respectively coupled to the baseboard through a switch.

* * * * *